US006318358B1

(12) United States Patent
Gatley, Jr.

(10) Patent No.: US 6,318,358 B1
(45) Date of Patent: Nov. 20, 2001

(54) FURNACE BLOWER WITH DOUBLE SIDED IMPELLER

(75) Inventor: William Stuart Gatley, Jr., Cassville, MO (US)

(73) Assignee: Jackel Incorporated, Highland, IL (US)

( * ) Notice: Subject to any disclaimer, the term of this patent is extended or adjusted under 35 U.S.C. 154(b) by 0 days.

(21) Appl. No.: 09/631,319

(22) Filed: Aug. 3, 2000

(51) Int. Cl.[7] ..... F24H 3/02

(52) U.S. Cl. ..... 126/110 R; 126/99 R; 126/312; 415/78; 415/368

(58) Field of Search ..... 126/110 R, 99 R, 126/307 R, 312, 116 R; 415/98.78, 97, 368, 139; 310/62, 63

(56) References Cited

U.S. PATENT DOCUMENTS

| | | | | |
|---|---|---|---|---|
| 2,654,529 | * | 10/1953 | Smith | 417/78 |
| 3,274,990 | * | 9/1966 | MacCracken | 126/110 R |
| 3,730,642 | * | 5/1973 | Barnstead | 417/98 |
| 4,236,443 | | 12/1980 | Schossow . | |
| 4,974,579 | * | 12/1990 | Shellenberger et al. | 126/110 R |
| 5,060,720 | | 10/1991 | Wollaber et al. . | |
| 5,309,892 | * | 5/1994 | Lawlor | 126/110 R |
| 5,350,281 | | 9/1994 | Hagshenas . | |
| 5,352,099 | * | 10/1994 | Austine et al. | 126/312 |
| 5,375,651 | | 12/1994 | Colwell . | |
| 5,478,275 | * | 12/1995 | Malm | 415/139 |
| 5,803,707 | | 9/1998 | Schips et al. . | |
| 5,814,908 | | 9/1998 | Muszynski . | |
| 6,231,311 | | 5/2001 | Gatley et al. . | |

* cited by examiner

*Primary Examiner*—James C. Yeung
(74) *Attorney, Agent, or Firm*—Howell & Haferkamp LC

(57) ABSTRACT

A blower for a furnace is provided where the blower has an impeller that is configured to create a primary air flow of combustion air into the blower housing and a secondary air flow of cooling air through the blower motor. The primary air flow of combustion air into the furnace generates hot exhaust gases for a heat exchanger in the furnace. The secondary air flow cools the blower motor. The secondary air flow is mixed with the hot exhaust gases in the blower housing and cools the exhaust gases before being discharged from the blower housing.

14 Claims, 6 Drawing Sheets

FURNACE BLOWER WITH DOUBLE SIDED IMPELLER

BACKGROUND OF THE INVENTION (1) Field of the Invention

This invention relates generally to a draft inducing blower in a furnace, and, more particularly, the invention pertains to an improvement in the blower design that provides internal cooling for a motor that drives the blower.

(2) Description of the Related Art

Blowers to which the present invention is directed are common in the art. Generally, these blowers are located downstream of a combustion chamber or combustion tubes in the furnace, depending upon the style of furnace. The blower draws combustion air into the combustion chamber or combustion tubes, where the combustion air is mixed with fuel and ignited to generate heat for the furnace. The heated exhaust gases are then drawn through a heat exchanger by the blower and discharged from the blower to an exhaust pipe that vents to the outside atmosphere.

The blower generally includes a blower housing and a blower motor installed on the blower housing. The blower housing typically has a side wall, top piece, and bottom piece that define a volute for the blower housing. When the blower is energized, an impeller, operably connected to a shaft of the blower motor, rotates in the volute to draw exhaust gases through an intake hole in the center of the bottom piece and to compress gases in the volute. The impeller draws exhaust gases directly from the combustion chamber or combustion tubes into the blower housing. The pressurized exhaust gases are directed into a discharge exit that extends outward and away from the side wall of the blower housing. The discharge exit is coupled to an exhaust pipe that vents the exhaust gases to atmosphere. In this arrangement, the impeller rotates at a high rate of speed to generate sufficient air flow to draw combustion air into the combustion chamber and combustion tubes and to expel the exhaust gases into the exhaust pipe.

In a typical conventional furnace, the combustion air is drawn into a vestibule of the furnace before it is directed into the combustion chamber or combustion tubes. Generally, the blower motor and blower housing are located in the vestibule with the blower intake in communication with the combustion chamber or combustion tubes. Control electronics for the furnace are also generally located in the vestibule.

During operation of the furnace, temperatures in the vestibule increase and tend to degrade performance of furnace components located in the vestibule. The proximity of the vestibule to the combustion chamber or tubes and the heat generated by the blower motor as the motor runs elevate the temperature within the vestibule. The hot exhaust gases circulating through the blower also contribute to the elevated temperatures in the vestibule. The elevated temperature within the vestibule tends to shorten the life of the blower motor, and electronics and controls located within the vestibule. However, because the blower draws relatively cool air into the vestibule before combustion, the vestibule is generally the preferred place on the conventional furnace for positioning temperature sensitive equipment for the furnace. Additionally, to maintain proper operation of the blower motor during the period of elevated temperature in the vestibule, conventional blower motors utilize an auxiliary fan attached to the rotating shaft of the motor to dissipate the heat generated by the motor.

Although the auxiliary fan usually provides adequate heat removal for the motor, the auxiliary fan has many disadvantages. First, the use of an auxiliary fan on the blower motor increases the size and/or height of the motor assembly, thereby preventing the streamlining of the motor assembly and reduction of the space reserved for the blower in the furnace. Because the auxiliary fan is generally positioned outside of the motor casing, guards and other safety devices must be attached to the motor casing to prevent inadvertent contact with the rotating fan blades during operation. The guard and the fan itself also add cost to the blower motor. The blower motor with an auxiliary fan generates additional noise. Finally, because the motor is positioned in the vestibule, the auxiliary fan recirculates and reuses air in the vestibule. This recirculation and reuse of the air in the vestibule contributes to the elevated temperatures of the vestibule and the associated components positioned therein. Because the motor operates in the vestibule at higher temperatures, the motor must again be upscaled in design, which adds cost to the blower.

Therefore, it is an object of the present invention to provide an improved blower that overcomes the disadvantages of conventional blowers, while providing a blower that cools the blower motor without the use of an auxiliary fan attached to the blower motor.

SUMMARY OF THE INVENTION

The present invention overcomes shortcomings of prior art furnaces that use an auxiliary fan attached to the blower motor to cool the blower motor. The blower of the present invention provides cooling for the blower motor with the flow of air induced by the blower.

The blower of the present invention has an impeller that is configured to create a primary air flow of combustion air into the blower housing and a secondary air flow through the blower motor. The secondary air flow is drawn through a casing of the blower motor and into the blower housing where it is mixed with the exhaust gases and discharged from the blower housing. Preferably, the blower housing has an enlarged shaft hole that is sized to allow sufficient cooling air to pass through the motor casing and motor into the blower housing.

During furnace operation, the impeller of the blower draws air into the vestibule. A first portion of the air is used by the furnace for combustion, and a smaller, second portion of the air is used for cooling the blower motor and exhaust gases. The impeller draws the second portion directly over the motor into the exhaust stream. Because the second portion is not recirculated with air in the vestibule, it does not contribute to the elevated temperature in the vestibule. As the air in the vestibule has not been recycled by the blower motor, the air in the vestibule is turned over and replaced more rapidly making the vestibule cooler.

The blower of the present invention eliminates the need for an auxiliary fan and allows for the blower to be more compact and streamlined. The blower of the present invention has no external rotating equipment, and the safety concerns and costs incident with the auxiliary rotating fan are obviated. The blower motor of the present invention allows the use of a lower cost blower motor while reducing the noise associated with the blower. When installed in the furnace, the blower of the present invention provides a cooler vestibule and therefore cooler environment for the furnace electronic controls. The blower of the present invention also cools the exhaust stream from the furnace so as to lower overall operating temperatures of the furnace.

BRIEF DESCRIPTION OF THE SEVERAL VIEWS OF THE DRAWINGS

Further objectives and features of the present invention are set forth in the following detailed description of the preferred embodiment of the invention and in the drawing figures wherein.

Corresponding reference characters indicate corresponding parts throughout the several views of the drawings.

DETAILED DESCRIPTION OF THE PREFERRED EMBODIMENT OF THE INVENTION

Figure 1:
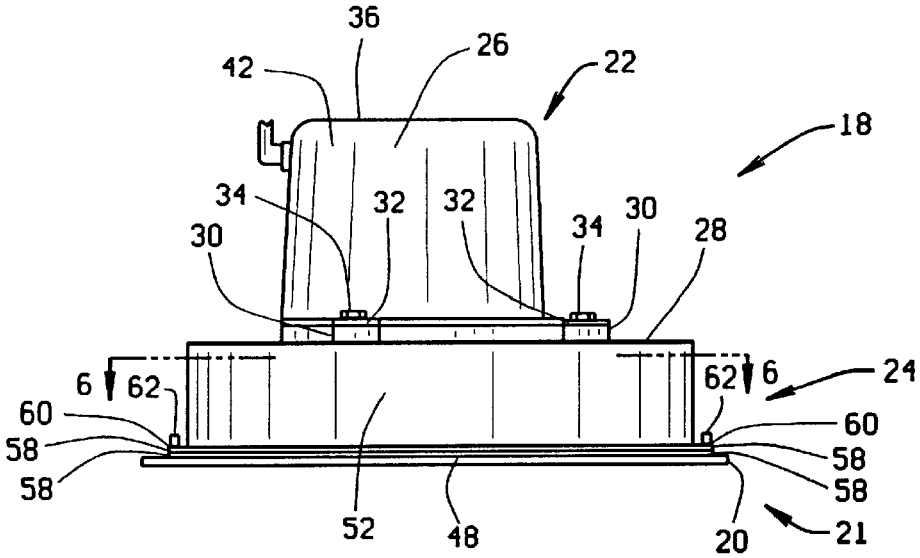
FIG. 1 is a side elevation view of a blower of the present invention.

FIGS. 1–6 provide details of the furnace blower 18 of the present invention. The blower 18 is positioned on a blower mounting surface 20 in a furnace 21 and includes a blower motor 22 and a blower housing 24. The blower motor 22 is preferably positioned on top of the blower housing 24 and contained within a motor casing 26. However, the motor 22 and blower housing 24 could have other relative positions. The motor casing 26 is supported on a first side wall 28 of the blower housing 24 by mounting feet 30 extending outward from the motor casing 26. The mounting feet 30 preferably have mounting holes 32, and mechanical fasteners 34 are directed through the mounting holes 32 to secure the motor casing 26 to the first side wall 28 of the blower housing 24.

Figure 2:
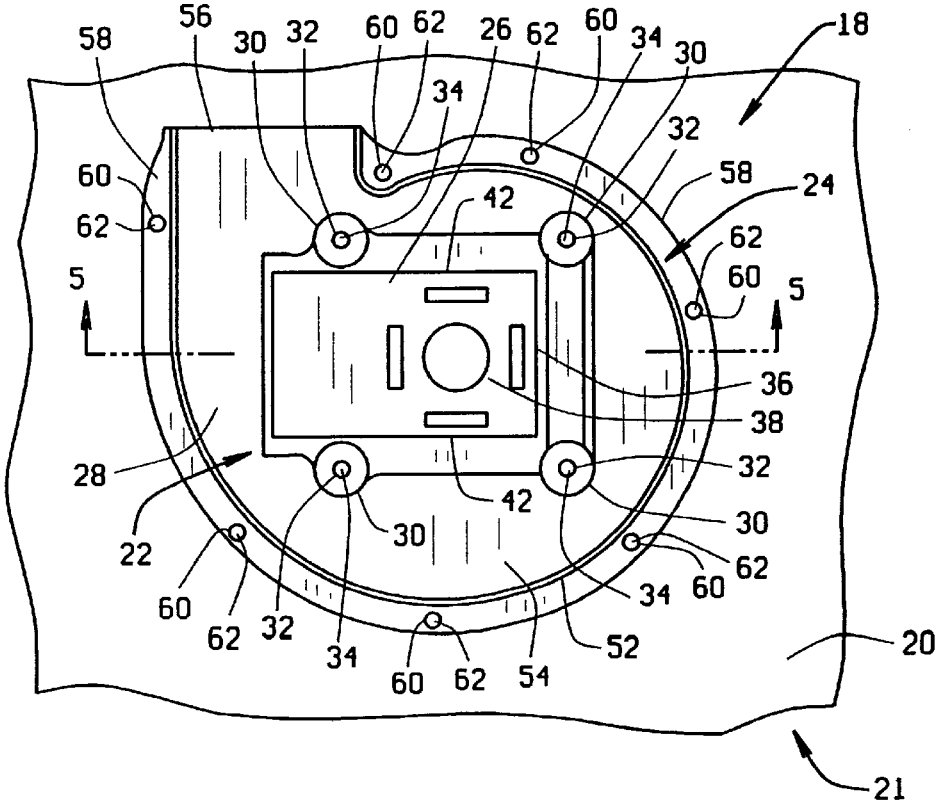
FIG. 2 is a top plan view of the blower of FIG. 1.
Figure 5:
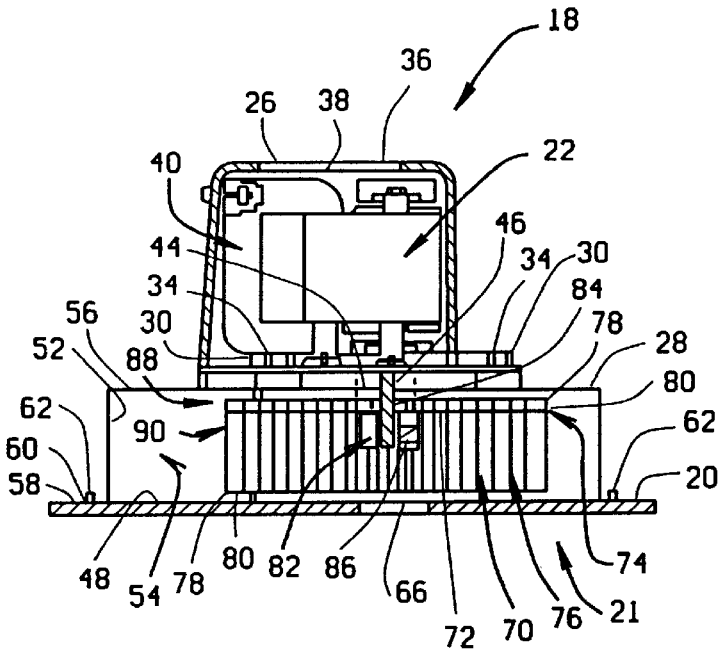
FIG. 5 is a cross sectional view of the blower of FIG. 1 taken along the line 5—5 of FIG. 2.
Figure 6:
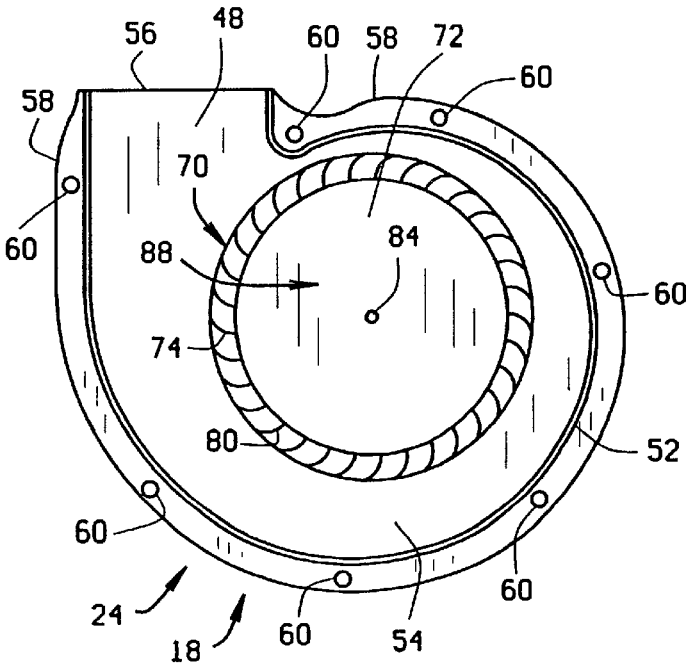
FIG. 6 is a top cross section view of a blower housing of the blower of FIG. 1 taken along the line 6—6 of Figure

As shown in FIG. 2, on a top side 36 of the motor 22 opposite the top, first side wall 28 of the blower housing 24, the motor casing 26 preferably has at least one vent hole 38 through the motor casing 26 that leads into an interior 40 of the motor casing 26 surrounding the motor 22. Although several vent holes 38 are shown positioned on the top side 36 of the motor casing 26, the vent holes may also be positioned along a top most edge of side walls 42 of the motor casing 26. As shown in FIG. 5, the motor casing 26 is also provided with a motor casing opening 44 preferably positioned adjacent the first side wall 36 of the blower housing 24. A blower motor shaft 46 extends from the motor 22 in the motor casing 26, through the motor casing opening 44 and into the blower housing 24. The motor casing opening 44 and the vent holes 38 have preferably the same cross sectional area and are preferably positioned on the spaced apart portions of the motor casing 26 to allow cooling air to flow through and cool as much of the motor 22 as possible.

On the blower housing 24 opposite the first side wall 28 is a bottom, second side wall 48 that rests adjacent the blower mounting surface 20 in the furnace 21. An upstanding wall 52 extends between a first and second side walls 28,48, and together the first and second side walls 28,48 and the upstanding wall 52 define a volute 54 of the blower housing 24. The blower housing 24 has a discharge exit 56 leading outward and away from the volute 54. The upstanding wall 52 and the bottom, second side wall 48 have flange portions 58 extending parallel to the blower mounting surface 20 with each of the flange portions 58 having a plurality of matching holes 60. Mechanical fasteners 62 are preferably threaded through the matching holes 60 into the blower mounting surface 20 to secure the blower housing 24 to the furnace 21.

Figure 3:
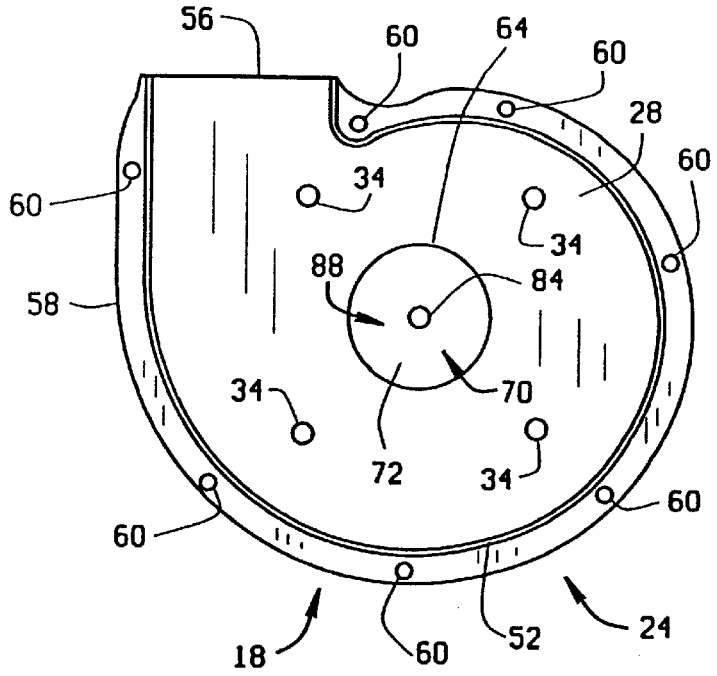
FIG. 3 is a top plan view of the blower of FIG. 1 with a blower motor removed from the blower.

As shown in FIG. 3, the top, first side wall 28 is formed with the upstanding wall 52 and has a shaft hole 64 that leads into volute 54 of the blower housing 24. The shaft hole 64 is preferably aligned with the motor casing opening 44 and receives the motor shaft 46 therethrough. The shaft hole 64 and motor casing opening 44 can have the same cross sectional area so as to not restrict the flow of cooling air from the interior 40 of the motor casing 26 into the blower housing 24.

Figure 4:
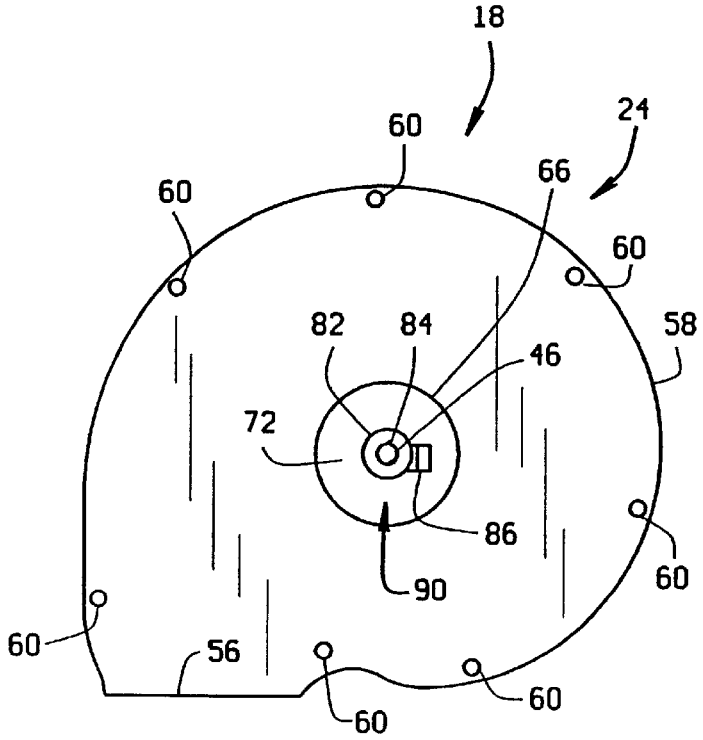
FIG. 4 is a bottom view of the blower of FIG. 1.

As shown in FIG. 4, the bottom, second side wall 48 of the blower housing is generally flat so that it may mount flush to the blower mounting surface 20 of the furnace 21. The bottom, second side wall 48 has a center intake 66 leading into the volute 54 of the blower housing 24. The center intake 66 is preferably positioned on the blower mounting surface 20 of the furnace 21 to allow combustion exhaust gases to flow directly into the blower housing 24. The center intake 66 preferably has the same cross section area as the shaft hole 64 and motor casing opening 44 to allow sufficient and balanced flow through the blower 18.

As shown in FIG. 5, the blower housing 24 has an impeller 70 rotatably disposed within the volute 54. The impeller 70 has a circular back plate 72 and a first set of blades 74 on one side of the circular back plate 72 and a second set of blades 76 on the opposite side of the back plate 72. Preferably, the blades of the first and second sets 74,76 are arranged in a circular pattern on their respective sides of the back plate 72. The first set of blades 74 is positioned adjacent the top, first side wall 28 of the blower housing 24, and the second set of blades 76 is positioned adjacent the bottom, second side wall 48. The blades 74,76 extend axially away from the back plate 72 and a support ring 78 is provided to hold a distal end 80 of each of the sets of blades 74,76 in a fixed perpendicular orientation to the backing plate 72. In this arrangement, the first set of blades 74 is shorter in axial length than the second set of blades 76 and therefore the first set of blades 74 produces a lower flow rate than the second set of blades 76. The impeller may also be provided with spiral vanes. In this arrangement, the geometry of the vanes is dimensioned so that the first set of vanes generates a lower flow rate than the second set of vanes.

The impeller 70 is operably connected to the motor shaft 46 through a connection bushing 82 located on the circular back plate 72 of the impeller 70. Because the size of the first set of blades 74 is reduced, the connection bushing 82 is preferably positioned on the underside of the circular back plate 72 in the center of the second set of blades 76. In this arrangement, the motor shaft 46 is directed through a center hole 84 in the circular back plate 70 and into the connection bushing 82. A set screw 86 or a press-on connection bushing 82 secures the impeller 70 to the motor shaft 46.

The backing plate 72 on the impeller 70 partitions the impeller 70 into a first section 88 and a second section 90 that is separated from the first section 88. The suction created by each of the sections 88,90 is separately induced by the rotation and orientation of the respective first and second sets of blades 74,76. When the impeller 70 is rotated by the blower motor 22, the first set of blades 74 in the first section 88 create a suction at the shaft hole 64 in the top side wall 28, and the second set of blades 76 in the second section 90 create a suction at the intake 66 at the bottom side wall 48. Because the shaft hole 64 is aligned with the motor casing opening 44, the first section 88 draws cooling air through the interior 40 of the motor casing 26 into the blower housing 24 while the second section 90 draws combustion products into the blower housing 24. The impeller 70 compresses the combustion products and cooling air together in the volute 54 and directs the mixed exhaust gases to the discharge exit 56.

The operation of the blower 18 in the furnace 21 will be discussed with reference to FIG. 7 to provide greater detail of the flow paths generated by the blower 18 in the furnace 21. Although the furnace 21 shown in FIG. 7 is a conventional low efficiency furnace (e.g. 80%), a blower 18 of the present invention may also be used in a high efficiency furnace (e.g. 90%) as shown in FIG. 8 with slight modifications to the blower housing to make it leak tight and resistant to higher temperature exhaust and condensate that forms in the exhaust gas stream.

Figure 7:
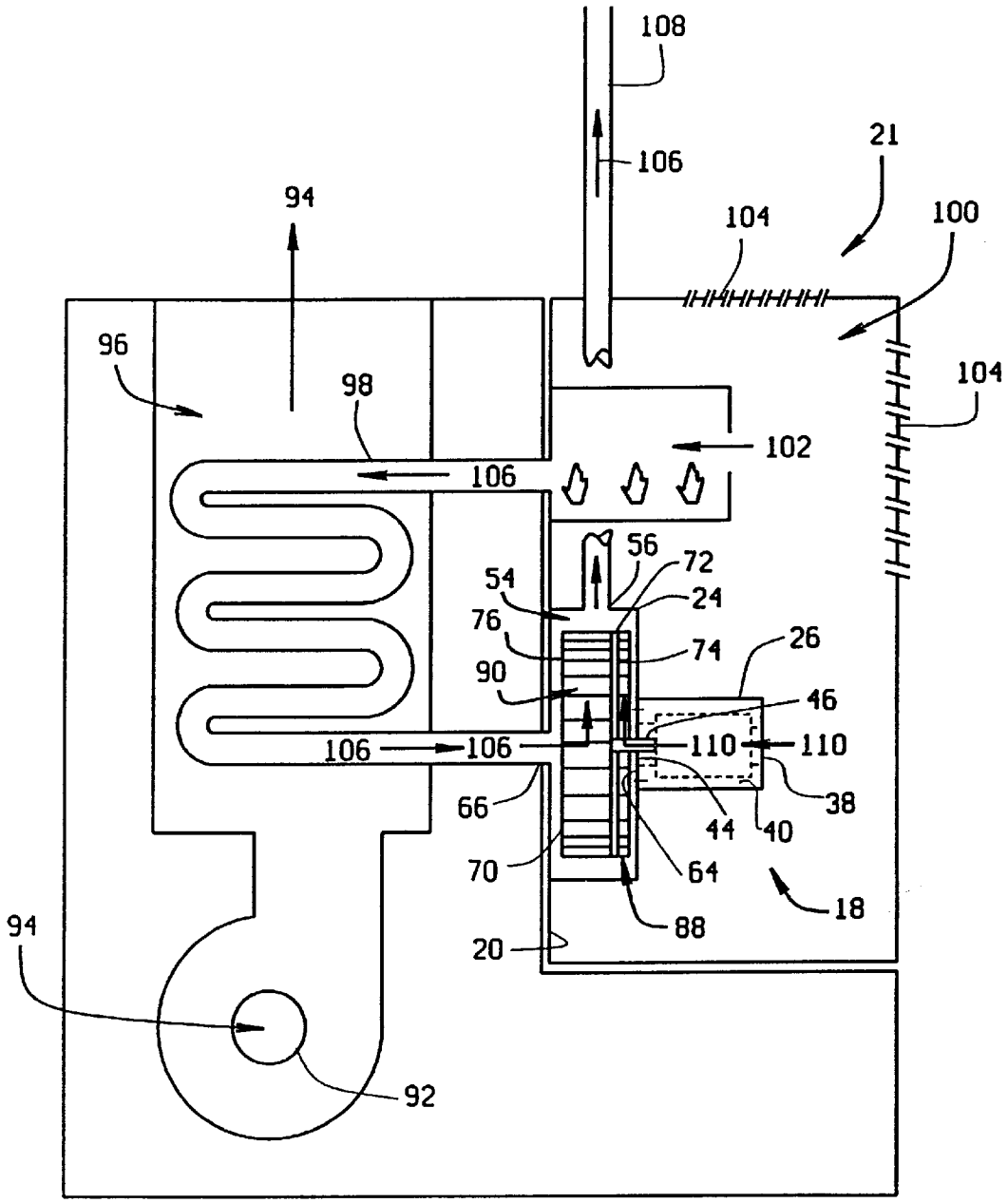
FIG. 7 is a schematic drawing of a conventional low efficiency furnace into which the blower of FIG. 1 is installed.
Figure 8:
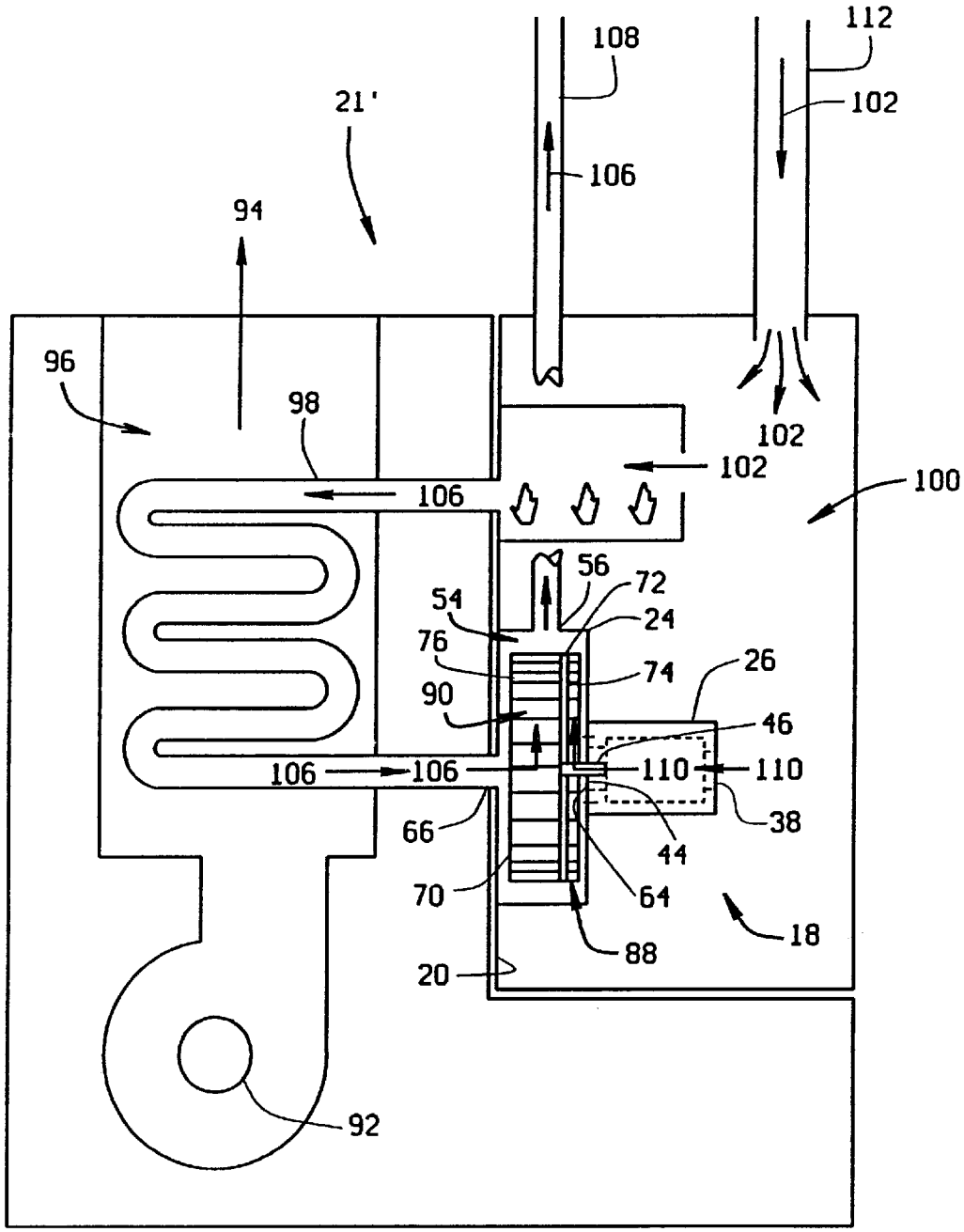
FIG. 8 is a schematic drawing of a conventional high efficiency furnace into which an alternative embodiment of the blower present invention is installed.

As shown in FIG. 7, the furnace 21 is provided with a main circulation fan 92 that draws a flow of air, generally indicated at reference number 94, from rooms of a house and pushes the flow of air 94 through a heat exchanger 96 around an exterior surface of combustion tubes 98 or combustion chamber, depending on style of furnace, wherein the flow of air 94 is heated and returned back into the rooms of the house.

Separated from the main circulation fan 92 and the duct work that contains the air flow 94 is a vestibule 100 of the furnace 21 and the blower 18 of the present invention. Preferably, the blower 18 is positioned on the blower mounting surface 20 in the vestibule 100 of the furnace 21. The motor casing 26 extends outward into the vestibule 100 with the second side wall 48 of the blower housing 24 mounted adjacent the discharge port of the combustion tubes/combustion chamber 98. The second section 90 of the impeller 70 in the blower 18 draws combustion air, generally indicated at 102, into the vestibule 100 from a furnace room in the house through louvers 104 in a side and top structure of the furnace 21. Then, the second section 90 of the impeller 70 draws the combustion air 102 into the combustion tubes/combustion chamber 98 and into the intake 66 of the blower housing 24 before expelling combustion products, generally indicated at 106, out the discharge exit 56 and into an exhaust pipe 108.

The first section 88 of the impeller 70 draws cooling air, generally indicated at 110, from the vestibule 100 through the vent holes 38 and the motor casing 26, out through the motor casing opening 44, and into the blower housing 24 through the shaft hole 64. The cooling air 110 is then mixed with the hot combustion products 106 as the impeller in the volute of the blower housing compresses the gases 106,110. The cooling air 110 cools the motor and the motor casing 26 as it is drawn through the motor casing 26 and lowers the temperature of the combustion products 106. Due to the location of the exhaust pipe 108 of the furnace 21 in the vestibule 100, the lower combustion products 106 temperature lowers the temperature of the vestibule 100. In a typical furnace, the vestibule chamber interior also contains the electronics and controls (not shown) to control the operation of the furnace 21. The flow of air 102 being drawn into the vestibule 100 along with the lower vestibule temperature cools the control electronics.

As shown in FIG. 8, the arrangement of the blower in a high efficiency furnace 21' produces flow paths through the furnace 21' that are similar to those described above with reference to the low efficiency furnace 21 of FIG. 7. The blower 18 draws the combustion air 102 into the vestibule 100 before entry in the combustion tubes/combustion chamber 98. The blower 18 is positioned in the vestibule 100 where the first section 88 of the impeller 70 may draw cooling air 110 directly from the vestibule 100 and through the motor casing 26. The second section 90 draws combustion products 106 into the blower where the combustion products are mixed with the cooling air 110 and discharged out the exhaust pipe 108. Because in the high efficiency furnace 21' the combustion air 102 is drawn from outside the house, the vestibule 100 is provided with an inlet pipe 112.

Figure 9:
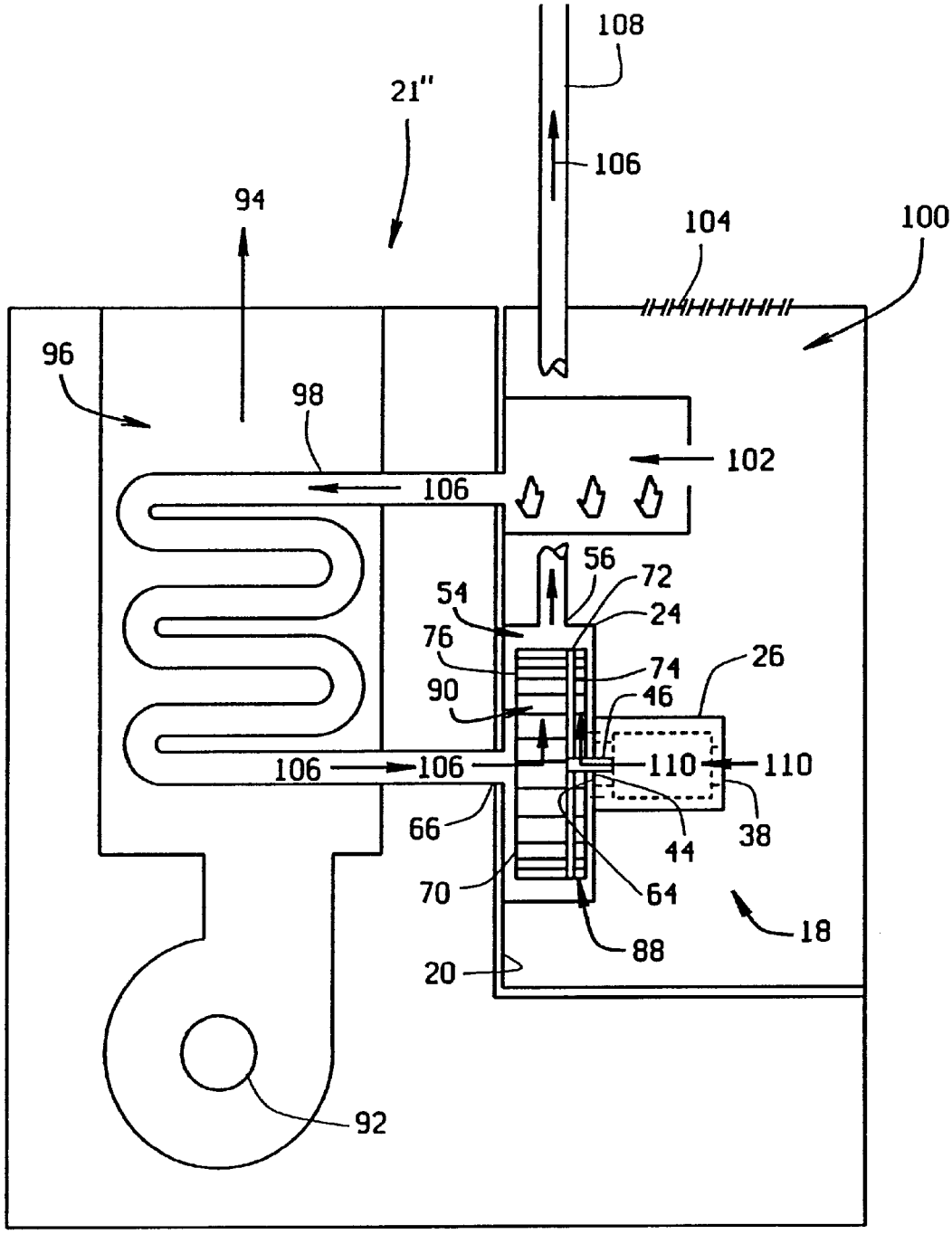
FIG. 9 is a schematic drawing of a alternate embodiment of the low efficiency furnace of FIG. 7.

FIG. 9 shows an alternate embodiment of a low efficiency furnace 21" in which the blower 18 of the present invention is installed. In this embodiment, combustion air 102 is drawn into the vestibule 100 through louvers 104 in a top structure of the furnace 21". The flow of combustion products 106 and cooling air 110 through the blower 18 is similar to that described above with reference to FIG. 7.

The blower of present invention provides improved cooling for the blower motor and the several other advantages described above. The blower may be used in a furnace or other type of appliance such as a hot water heater or clothes dryer where combustion products must be actively evacuated from the appliance.

While the present invention has been described by reference to specific embodiments, it should be understood that modifications and variations of the invention may be constructed without departing from the scope of the invention as defined by the following claims.

What is claimed is:

1. A furnace comprising:

a vestibule for accumulating incoming air for combustion in the furnace;

a motor having a motor shaft with a rotation axis and a motor casing surrounding the motor, the motor casing having at least one motor casing opening;

a blower housing containing an impeller connected to the motor shaft for rotation with the motor shaft to draw air into the vestibule, the blower housing including a shaft hole for receiving the motor shaft therethrough, the shaft hole being aligned with the motor casing opening, whereby the motor casing is in communication with an interior of the blower housing and the impeller draws cooling air into the blower housing from the motor casing for cooling the motor and motor casing;

the impeller has a circular back plate fixed on the motor shaft, a first set of blades arranged in a circular pattern on one side of the back plate and a second set of blades arranged in a circular pattern on the opposite side of the back plate, the blades of the first and second sets are fixed to the back plate and extend axially outward from opposite sides of the back plate; and the blades of the first set of blades have a smaller axial length than the blades of the second set of blades.

2. The furnace of claim 1, wherein:

the motor casing has at least one vent hole through the motor casing and cooling air flows through the motor casing from the at least vent hole to the at least one motor casing opening.

3. The furnace of claim 1, wherein:

the impeller back plate divides the impeller into a first portion and a second portion whereby the first portion draws cooling air from the motor casing into the blower housing and the second portion draws furnace combustion products into the blower housing.

4. The furnace of claim 3, wherein:

the blower housing has a discharge exit from the blower housing and the cooling air and the furnace combustion products are mixed in the blower housing and then discharged through the discharge exit of the blower housing after the cooling air flows through the motor casing, whereby the cooling air lowers a temperature of the furnace combustion products.

5. The furnace of claim 2, wherein:

the cooling air is drawn from the vestibule directly into the motor casing through the at least one vent, whereby the vestibule is cooled by a movement of air from the vestibule into the blower housing.

6. The furnace of claim 1, wherein:

the shaft hole has a perimeter edge spaced from but adjacent to the motor shaft whereby the cooling air flows along the motor shaft from the motor casing into the blower housing to cool the motor casing.

7. A blower for a furnace, the blower comprising:

a blower motor including a motor casing and a motor shaft with a rotation axis, the motor casing having an inlet and an outlet;

a blower housing having generally circular first and second side walls with an annular wall extending between the first and second side walls to form the blower housing, the blower housing having an impeller rotatably disposed within the blower housing and operably connected to the motor shaft, the second side wall having a primary intake into the blower housing that is connected in communication with a combustion chamber of the furnace, the first side wall supporting the blower motor and having a shaft hole for receiving the motor shaft therethrough, the first side wall being spaced from the motor shaft, the shaft hole being in communication with the outlet of the motor casing, whereby the impeller draws cooling air from the aligned shaft hole and outlet when the impeller is rotated by the motor;

the impeller having a circular back plate fixed on the motor shaft, a first set of blades arranged in a circular pattern on one side of the back plate and a second set of blades arranged in a circular pattern on the opposite side of the back plate, the blades of the first and second sets are fixed to the back plate extending axially outward from opposite sides of the back plate;

the blades of the first set of blades having a smaller axial length than the blades of the second set of blades;

the impeller back plate dividing the impeller into a first portion and a second portion, the first portion drawing cooling air through the motor casing from the aligned shaft hole and outlet of the motor casing into the blower housing and the second portion drawing furnace combustion products from the combustion chamber through the primary intake of the blower housing when the impeller is rotated by the motor; and the blower housing is shaped as a volute that causes the cooling air and the furnace combustion products to be mixed in the blower housing when the impeller is rotated by the motor, whereby a temperature of the furnace combustion products is lowered by the cooling air.

8. The blower of claim 7, wherein:

the impeller has a first set of blades adjacent the shaft hole and outlet hole, and a second set of blades separated from the first set of blades and adjacent the primary intake.

9. The blower of claim 7, wherein:

the inlet and outlet of the motor casing are aligned with the shaft hole of the blower housing.

10. A blower comprising:

a blower motor including a motor casing and a motor shaft with a rotation axis, the motor casing having an inlet and an outlet; and a blower housing having generally circular first and second side walls with an annular wall extending between the first and second side walls to form the blower housing, the blower housing having an impeller rotatably disposed within the blower housing and operably connected to the motor shaft, the second side wall having a primary intake into the blower housing, the first side wall supporting the blower motor and having a shaft hole for receiving the motor shaft therethrough, the first side wall being spaced from the motor shaft, the shaft hole being in communication with the outlet of the motor casing, whereby the impeller draws cooling air into the blower housing through the motor casing from the aligned shaft hole and outlet when the impeller is rotated by the motor; and the impeller having a circular back plate fixed on the motor shaft, a first set of blades arranged in a circular pattern on one side of the back plate and a second set of blades arranged in a circular pattern on the opposite side of the back plate, the blades of the first set of blades are smaller than the blades of the second set of blades, and the blades are fixed to the impeller back plate.

11. A blower comprising:

a motor having a shaft;

an impeller housing operatively connected to the motor;

an impeller contained in the impeller housing and mounted on the motor shaft, the impeller having a circular back plate with a center axis, a first set of blades arranged in a circular pattern on one side of the back plate and a second set of blades arranged in a circular pattern on an axially opposite side of the back plate, the blades of the first and second sets are fixed to the back plate and extend axially outward from opposite sides of the back plate; and the first and second sets of blades have axial lengths and the axial length of the first set of blades is smaller than the axial length of the second set of blades.

12. The blower of claim 11, wherein:

the first set of blades is on a side of the back plate that is adjacent the motor and the second set of blades is on a side of the back plate that is axially opposite the motor.

13. The blower of claim 11, wherein:

the impeller housing has first and second side walls on axially opposite sides of the impeller, the first and second side walls each have a center opening that is coaxial with the back plate center axis and the center openings of the first and second side walls are substantially the same size.

14. The blower of claim 11, wherein:

the motor housing is in communication with an interior of the impeller housing whereby the impeller first set of blades draw cooling air through the motor casing and into the impeller housing for cooling the motor and the motor casing.

* * * * *